US009404669B2

(12) United States Patent
Mercer et al.

(10) Patent No.: US 9,404,669 B2
(45) Date of Patent: Aug. 2, 2016

(54) APPLICATION OF ELECTRIC HEAT COIL IN FAN UNIT

(71) Applicants: Kevin Mercer, Danville, IN (US); Frank J. David, Avon, IN (US)

(72) Inventors: Kevin Mercer, Danville, IN (US); Frank J. David, Avon, IN (US)

(73) Assignee: CARRIER CORPORATION, Farmington, CT (US)

( * ) Notice: Subject to any disclaimer, the term of this patent is extended or adjusted under 35 U.S.C. 154(b) by 366 days.

(21) Appl. No.: 14/043,950

(22) Filed: Oct. 2, 2013

(65) Prior Publication Data

US 2014/0099086 A1 Apr. 10, 2014

Related U.S. Application Data

(60) Provisional application No. 61/709,751, filed on Oct. 4, 2012.

(51) Int. Cl.

| | |
|---|---|
| ***F24D 5/00*** | (2006.01) |
| ***F24H 3/02*** | (2006.01) |
| ***F24H 3/00*** | (2006.01) |
| ***F24H 3/04*** | (2006.01) |
| ***H05B 6/16*** | (2006.01) |

(52) U.S. Cl.

CPC ..... *F24H 3/002* (2013.01); *F24H 3/0405* (2013.01); *F24H 3/0411* (2013.01); *H05B 6/16* (2013.01)

(58) Field of Classification Search

None

See application file for complete search history.

(56) References Cited

U.S. PATENT DOCUMENTS

| | | | | |
|---|---|---|---|---|
| 3,827,483 | A * | 8/1974 | Hopkinson | F24F 1/022 165/122 |
| 3,960,527 | A * | 6/1976 | Goettl | F04D 17/162 415/151 |
| 3,977,467 | A * | 8/1976 | Northrup, Jr. | F24H 3/0405 165/122 |
| 5,121,613 | A * | 6/1992 | Cox | F24F 1/0007 165/127 |
| 5,277,036 | A * | 1/1994 | Dieckmann | F24F 3/044 165/76 |
| 5,284,027 | A * | 2/1994 | Martin, Sr. | F24F 13/30 165/126 |
| 5,332,028 | A * | 7/1994 | Marris | F24D 15/04 165/233 |
| 5,428,964 | A | 7/1995 | Lobdell | |
| 6,484,523 | B2 | 11/2002 | Kuroda et al. | |
| 6,550,257 | B1 * | 4/2003 | Goetzinger | F24F 3/166 62/291 |
| 6,883,602 | B2 | 4/2005 | Drucker | |
| 6,950,606 | B2 | 9/2005 | Logan et al. | |
| 7,190,887 | B1 * | 3/2007 | Compton | F24H 3/0417 219/533 |
| 7,216,698 | B2 | 5/2007 | Catzel | |
| 7,251,953 | B2 | 8/2007 | Wetzel et al. | |

(Continued)

FOREIGN PATENT DOCUMENTS

| | | | |
|---|---|---|---|
| GB | 2428470 | A | 1/2007 |
| JP | 2010071533 | A | 4/2010 |

(Continued)

*Primary Examiner* — Thor Campbell

(74) *Attorney, Agent, or Firm* — Cantor Colburn LLP

(57) ABSTRACT

An electric heat coil assembly for use adjacent a heat exchanger assembly in a fan coil unit is provided including at least one electric heat coil. A mount plate supports the at least one electric heat coil such that the at least one electric heat coil extends from the mount plate. The mount plate includes an edge configured to connect to the heat exchanger assembly. At least one relay is coupled to the at least one electric heat coil. The at least one relay selectively applies power to the electric heat coil.

15 Claims, 6 Drawing Sheets

(56) References Cited

U.S. PATENT DOCUMENTS

| | | | | |
|---|---|---|---|---|
| 7,355,146 | B2 * | 4/2008 | Angelis | B60H 1/00471 165/42 |
| 8,428,445 | B2 * | 4/2013 | Abbott | C23C 4/06 219/543 |
| 8,463,113 | B2 * | 6/2013 | Hwang | F24H 3/0405 392/347 |
| 8,696,419 | B2 * | 4/2014 | Liang | F04D 29/58 392/349 |
| 8,948,576 | B2 * | 2/2015 | Logan | F24F 3/0442 392/360 |
| 2002/0168183 | A1 * | 11/2002 | Arnold | F24H 9/02 392/360 |
| 2005/0147400 | A1 * | 7/2005 | Logan | F24F 1/0007 392/360 |
| 2006/0273183 | A1 * | 12/2006 | Cavanagh | F24F 3/153 236/44 C |
| 2007/0235161 | A1 | 10/2007 | Barger et al. | |
| 2008/0148746 | A1 | 6/2008 | Yanik et al. | |
| 2010/0307733 | A1 | 12/2010 | Karamanos et al. | |
| 2010/0326624 | A1 * | 12/2010 | Hancock | F24F 3/0422 165/47 |
| 2015/0033776 | A1 * | 2/2015 | Mercer | F24F 1/0007 62/89 |
| 2015/0219386 | A1 * | 8/2015 | Zinger | F25D 21/08 62/276 |

FOREIGN PATENT DOCUMENTS

| | | | |
|---|---|---|---|
| WO | 03029720 | A1 | 4/2003 |
| WO | 2006110944 | A1 | 10/2006 |
| WO | 2007000624 | A1 | 1/2007 |
| WO | 2010064375 | A1 | 6/2010 |

* cited by examiner

APPLICATION OF ELECTRIC HEAT COIL IN FAN UNIT

CROSS-REFERENCE TO RELATED APPLICATIONS

This application claims the benefit of U.S. provisional patent application Ser. No. 61/709,751, filed Oct. 4, 2012, the entire contents of which are incorporated herein by reference.

BACKGROUND OF THE INVENTION

The invention relates generally to a fan coil unit of a heating, ventilation, and air conditioning system, and, more particularly, to an electric heater coil accessory configured for use with a fan coil unit.

In a conventional air conditioning system, the condenser of the refrigeration circuit is located exterior to a building. Typically, this system includes a condensing coil, a fan for circulating outdoor ambient air over the condensing coil, and may additionally have a compressor, reversing valves, and various controls. The air conditioning system further includes an indoor unit having an evaporator for transferring heat energy from the indoor air to be conditioned to the refrigerant flowing through the evaporator and a fan for circulating the indoor air in a heat exchange relationship with the evaporator. This type of unit is referred to as a fan coil unit.

In conventional fan coil units, especially those used in warmer climates having a reduced heating demand, an auxiliary electric heat coil accessory may be mounted to the fan coil unit. By including an electric heat coil accessory, the air conditioning system can be adapted to provide both cool and warm air to a building. This electric heat coil accessory connects to the discharge end of the fan coil unit and therefore increases the overall height of the fan coil unit. Because many applications have strict size envelopes within which the fan coil unit must fit, inclusion of the additional electric heat coil accessory is not always possible. In addition, the added height of the accessory makes the fan coil unit more difficult to install.

BRIEF DESCRIPTION OF THE INVENTION

According to another aspect of the invention, an electric heat coil assembly for use adjacent a heat exchanger assembly in a fan coil unit is provided including at least one electric heat coil. A mount plate supports the at least one electric heat coil such that the at least one electric heat coil extends from the mount plate. The mount plate includes an edge configured to connect to the heat exchanger assembly. At least one relay is coupled to the at least one electric heat coil. The at least one relay selectively applies power to the electric heat coil.

According to yet another aspect of the invention, a fan coil unit is provided including a housing duct. A fan assembly circulates air through the housing duct. A heat exchanger assembly is arranged with the housing duct. The heat exchanger assembly is in a heat transfer relationship with the air circulating through the housing duct, At least one open space exists adjacent the heat exchanger assembly. An electric heat coil assembly is located within the at least one open space adjacent the heat exchanger assembly.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
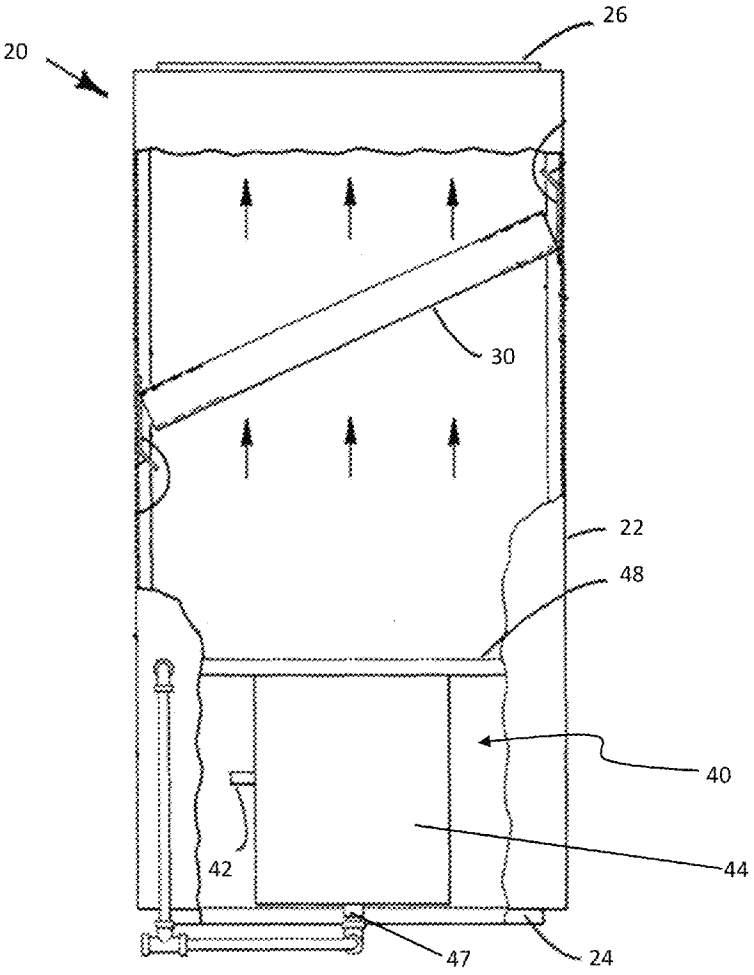
FIG. 1 is a front view of an exemplary fan coil unit.
Figure 2:
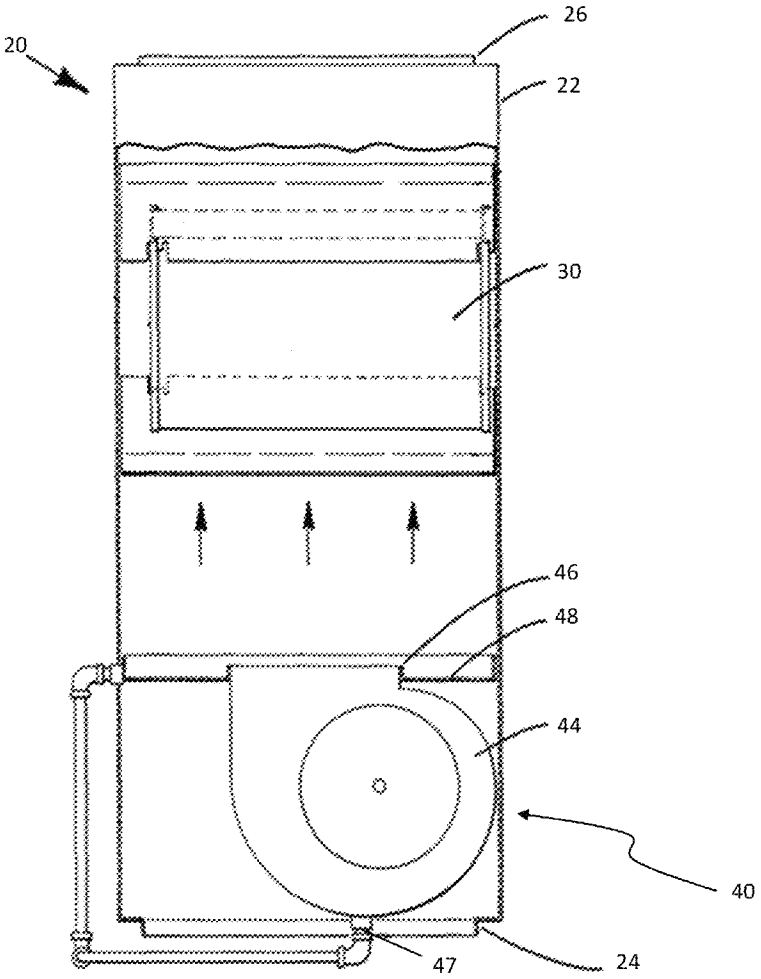
FIG. 2 is a side view of the exemplary fan coil unit shown in FIG. 1.

Referring now to FIGS, 1 and 2, heating and cooling systems include a ducted fan coil unit 20 having a fan assembly 40 and a heat exchanger assembly 30 disposed inside a housing duct 22. Depending on the desired unit characteristics, the fan assembly 40 may be positioned either downstream with respect to the coil assembly 30 (i.e. a "draw through" configuration), or upstream with respect to the coil assembly 30 (i.e. a "blow through" configuration) as shown in FIGS. 1 and 2. The housing duct 22 includes a lower duct connector 24 and an upper duct connector 26 that define inlet and outlet openings.

In the illustrated embodiment, the fan assembly 40 is mounted near the inlet 24 of the unit 20. The fan assembly 40 includes a fan scroll 44 coordinated with a fan mounted to a fan shaft 42 and is configured to circulate air generally forwardly into the heat exchanger assembly 30. A combination fan deck and condensate pan 48 extends across the unit 20 located at the same height as the discharge end 46 of the fan scroll 44. The combination fan deck and condensate pan 48 collects condensate dripping from the surface of the heat exchanger assembly 30 and prevents air discharged from the fan assembly 40 from circulating back to the fan inlet 47. The heat exchanger assembly 30, in the illustrated embodiment, has a generally flat profile and is arranged at an angle with respect to the flow path of air through the housing duct 22. Alternative heat exchanger assemblies 30 are generally V-shaped and generally A-shaped as is known in the art (see FIGS. 5 and 6). The fan assembly 40 directs air into the heat exchanger assembly 30 to either heat or cool the air. The heat exchanger assembly 30 includes a large surface area exposed to the flow path of the air to optimize heat transfer with the air flowing there through.

FIG. 2 is a side view of the fan coil unit 20 illustrated in FIG. 1, The discharge end 46 of the fan scroll 44 is shown extending through a portion of the combination deck and condensate pan 48. Hence, it may be seen that the discharge end 46 of the fan scroll 44 is utilized to direct the air being circulated by the fan upwardly through the heat exchanger assembly 30 and out the unit 20 at the upper duct connector 26. Although a particular fan coil unit 20 configuration is illustrated and described in the disclosed embodiment, other configurations are within the scope of the present invention.

Figure 3:
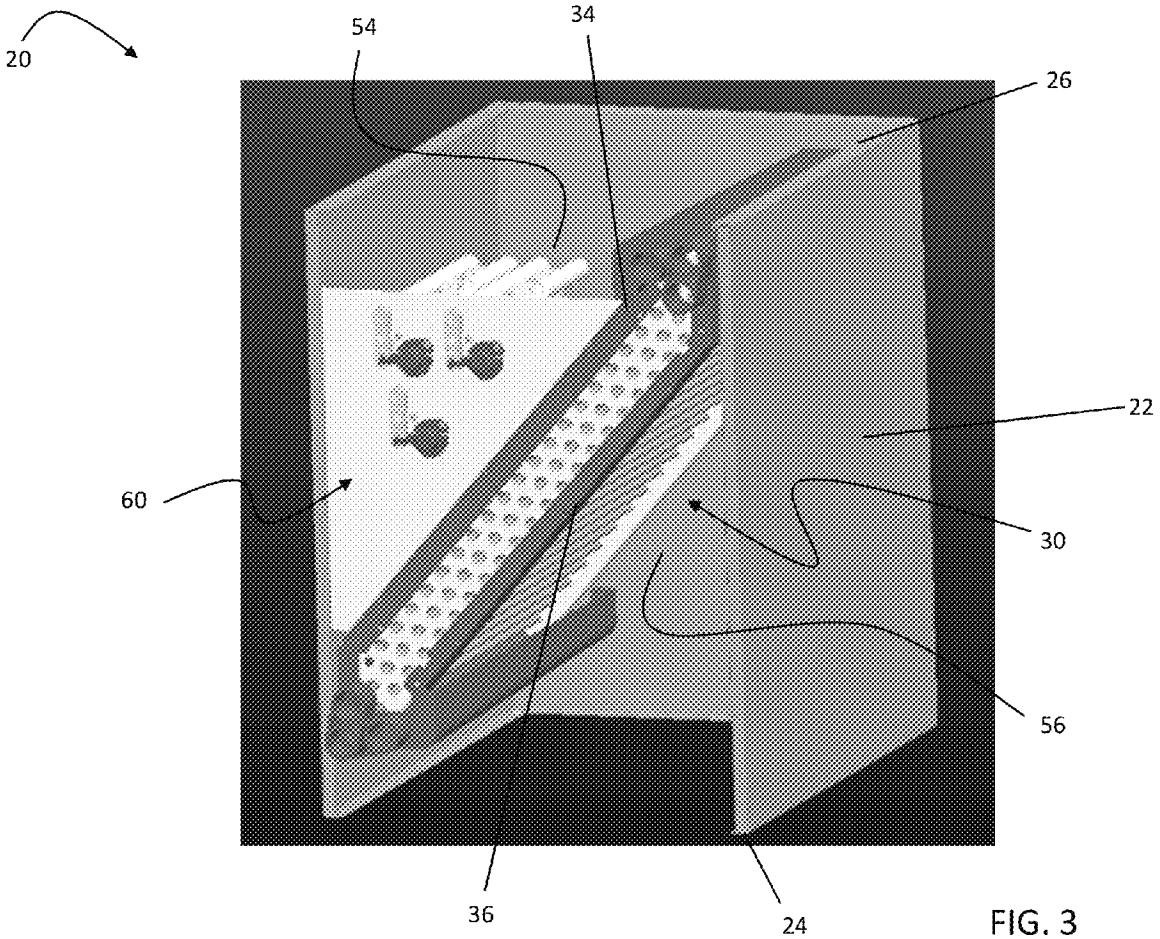
FIG. 3 is a perspective view of a fan coil unit in accordance with an embodiment of the invention.

Referring now to FIG. 3, a fan coil unit 20 according to one embodiment of the present invention is illustrated. The illustrated fan coil unit 20 includes an electric heat coil assembly 60 positioned in an open area 54 between the heat exchanger assembly 30 and the housing duct 22. The contour of the electric heat coil assembly 60 may be complementary to the shape of the open area 54 between the heat exchanger assembly 30 and the housing duct 22. For example, a portion of the electric heat coil assembly 60 may be arranged at an angle equal to the angle at which the heat exchanger assembly 30 is positioned relative to the air flow path in the housing duct 22. In one embodiment, the electric heat coil assembly 60 is generally triangular in shape. Regardless of whether the fan coil unit 20 has a "draw through" configuration or a "blow through" configuration, the electric heat coil assembly 60 may be positioned adjacent the discharge side 34 of the heat exchanger assembly 30 in open space 54, Air exiting the discharge side 34 of the heat exchanger assembly 30 is therefore heated by the electric heat coil assembly 60 before being circulated into a duct (not shown) connected to the outlet side 26 of the housing duct 22, such as a duct leading into a portion of a building to be heated for example. Alternatively, the electric heat coil assembly 60 may be positioned in the open space 56 adjacent the inlet side 36 of the heat exchanger assembly 30.

Figure 4:
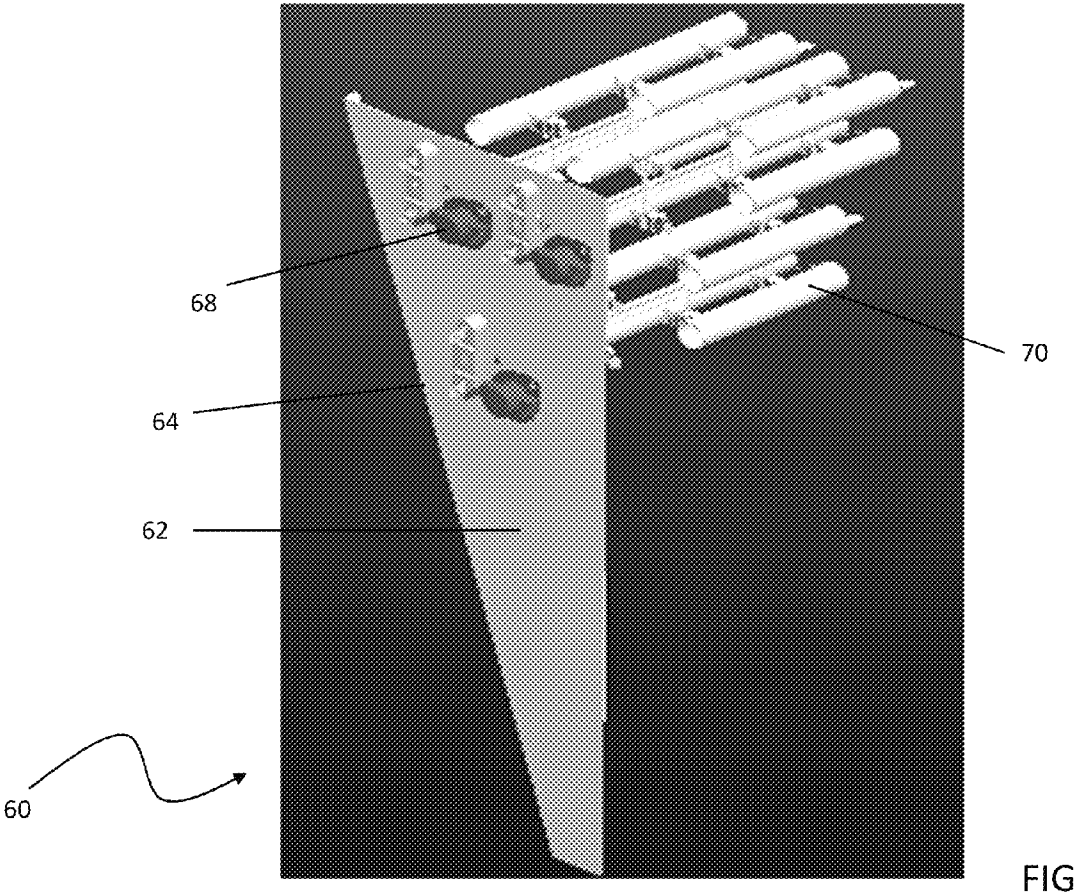
FIG. 4 is a perspective view of an electric heat coil assembly in accordance with an embodiment of the invention.

An electric heat coil assembly 60 according to an embodiment of the invention is illustrated in FIG. 4. The electric heat coil assembly 60 includes at least one electric heat coil 70 connected to a mounting plate 62. In one embodiment, the electric heat coil assembly 60 includes a plurality of bunched electric heat coils 70 extending from the mounting plate 62. The electric heat coils 70 may extend perpendicularly or at an angle to the mounting plate 62. Each of the plurality of electric heat coils 70 may be generally equal in length or alternatively, the electric heat coils 70 may vary in length. At least one switching device 68, such as a relay for example, is coupled to the electric heat coils 70 through the mounting plate 62. The switching device 68 selectively applies power to the electric heat coils 70 to heat air flowing through the coils 70. The mounting plate 62 is substantially flat and may be formed, for example, from a piece of sheet metal. In one embodiment, at least one edge 64 of the mounting plate 62 is configured to connect to a portion of the heat exchanger assembly 30. By joining the edge 64 of the mounting plate 62 to the heat exchanger assembly 30, the plurality of electric heat coils 70 are supported in a position near the heat exchanger assembly 30.

Figure 5:
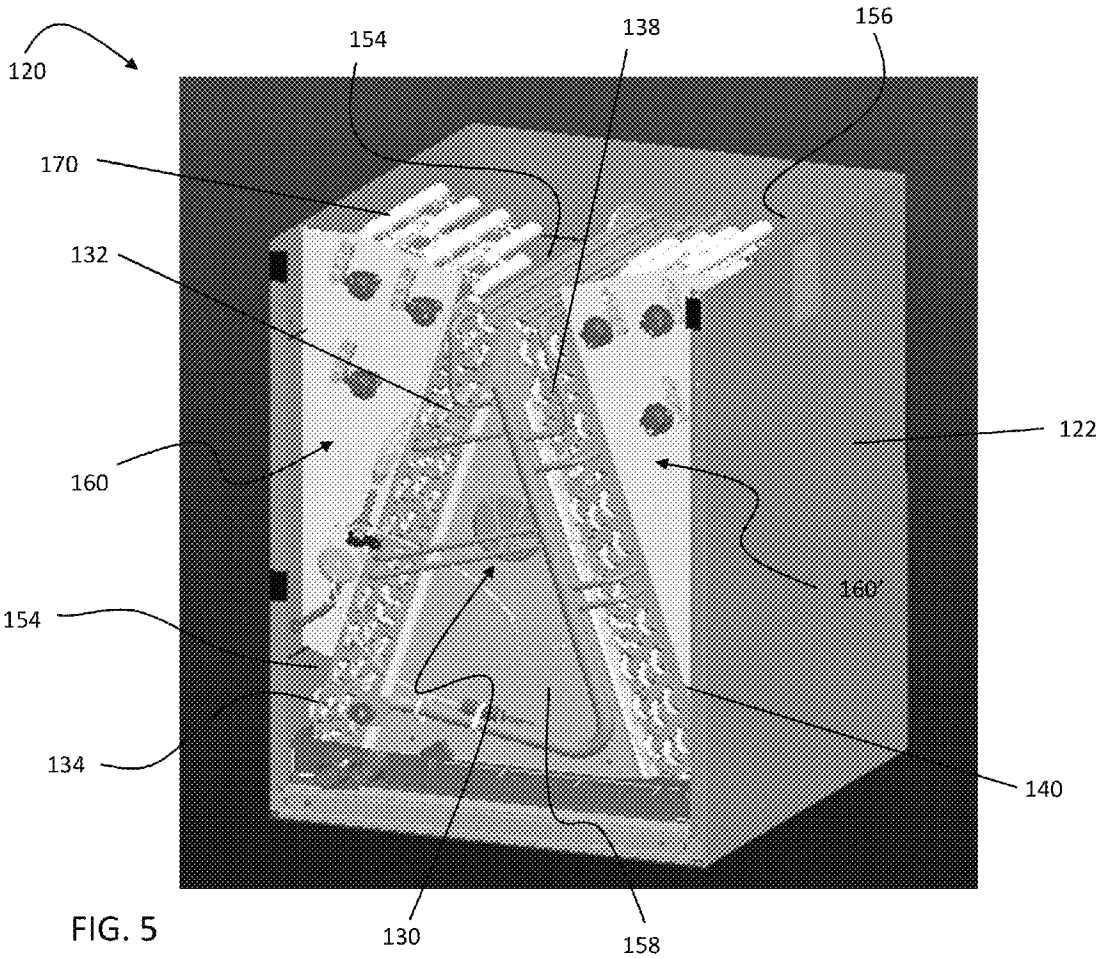
FIG. 5 is a perspective view of an alternate fan coil unit in accordance with an embodiment of the invention.

Referring now to FIG. 5, another fan coil unit 120 according to an embodiment of the present invention is shown. The heat exchanger assembly 130 of the illustrated fan coil unit 120 includes multiple portions such that multiple open spaces exist between the heat exchanger assembly 130 and the housing duct 122. The illustrated heat exchanger assembly 130 includes a substantially symmetrical first portion 132 and second portion 138. A first open space 154 is formed between the first portion 132 and the housing duct 122 and a second open space 156 is formed between the second portion 138 and the housing duct 122. In addition, a third open space 158 exists between the first portion 132 and the second portion 138 of the heat exchanger assembly 130. The heat exchanger assembly 130 shown in FIG. 5 is a generally A-shaped and is commonly referred to as an "A-coil".

In one embodiment, at least one electric heat coil assembly 160 is mounted in one of the open areas 154, 156, 158 adjacent the A-coil 130. As illustrated, a first electric heat coil assembly 160 is mounted in the open area 154 adjacent the discharge surface 134 of the first portion 132 and a second electric heat coil 160' is mounted in the open area 156 adjacent the discharge surface 140 of the second portion 138 of the heat exchanger assembly 130. The first electric heat coil assembly 160 and the second electric heat coil assembly 160' may be substantially symmetrical to one another. Alternatively, the first electric heat coil assembly 160 and the second electric heat coil assembly 160' may have different shapes, sizes, number and arrangements of electric heat coils 170.

Figure 6:
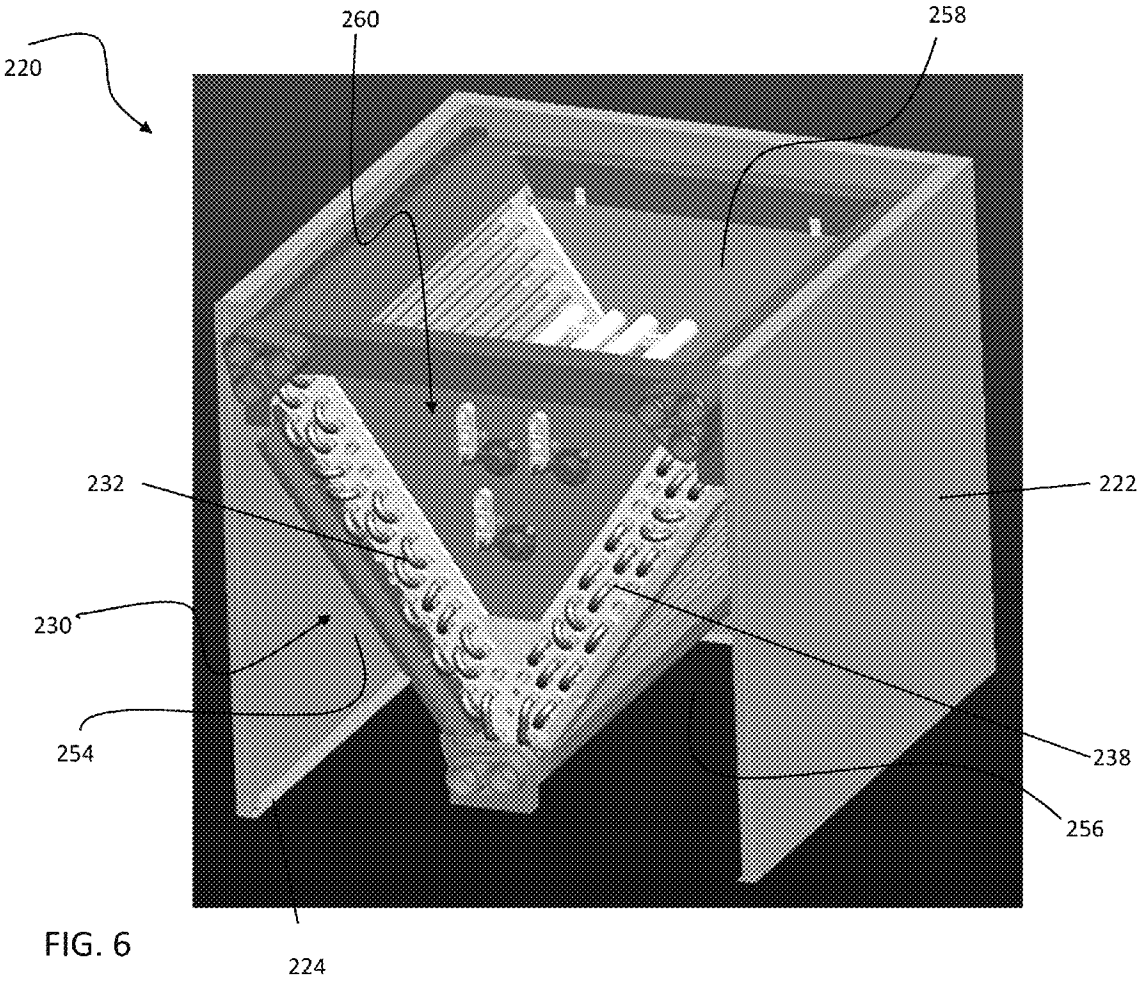
FIG. 6 is a perspective view of an alternate fan coil unit in accordance with an embodiment of the invention.

The heat exchanger assembly 230 of the fan coil unit 220 illustrated in FIG. 6, similarly includes a first portion 232 and a second portion 238, such that a first open space 254 and a second open space 256 exist between the heat exchanger assembly 230 and the housing duct 222 and a third open space 258 exists between the first and second portions 232, 238 of the heat exchanger assembly 230. The heat exchanger assembly 230 is generally V-shaped and is commonly referred to as a "V-coil". The V-coil heat exchanger assembly 230 is substantially similar to the A-coil heat exchanger assembly 130 shown in FIG. 5, but is inverted within the housing duct 222 such that the first portion 232 and the second portion 238 are joined adjacent the inlet end 224 of the housing duct 222, At least one electric heat coil assembly 260 is mounted in one of the open areas 254, 256, 258 adjacent the V-coil 230. In one embodiment, at least one electric heat coil assembly 260 is positioned within the open area 258 between the first portion 232 and the second portion 238 of the heat exchanger assembly 230. As illustrated, a single electric heat coil assembly 260 may be configured to fit within open space 258 adjacent the discharge surfaces 234, 240 of the heat exchanger assembly 230. However, multiple electric heat coil assemblies 260 may be configured to fit within an open space, such as open space 258 for example. If multiple electric heat coil assemblies 260 are located within an open space, the electric heat coil assemblies 260 may be substantially uniform in size and shape. Alternatively, the multiple electric heat coil assemblies 260 within an open space may be distinct sizes and shapes that fit within the open space.

By including at least one electric heat coil assembly within the open spaces, of the housing duct, the overall height of the fan coil unit is reduced, such as by a distance of approximately eight to ten inches, This reduction in height allows for greater flexibility during installation of the fan coil unit.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fan coil unit comprising:

a housing duct;

a fan assembly for circulating air through the housing duct;

a heat exchanger assembly arranged within the housing duct in a heat transfer relationship with the air circulating through the housing duct, wherein at least one open space exists adjacent the heat exchanger assembly; and an electric heat coil assembly located within the at least one open space adjacent the heat exchanger assembly;

wherein the at least one open space adjacent the heat exchanger assembly is triangular and the electric heat coil assembly includes a plurality of electric heat coils arranged in a triangular shape.

2. The fan coil unit according to claim 1, wherein the electric heat coil assembly comprises:

the plurality of electric heat coils;

a mount plate for supporting the plurality of electric heat coils such that the plurality of electric heat coils extend from the mount plate, the mount plate having an edge configured to connect to the heat exchanger assembly; and at least one switching device coupled to at least one electric heat coil for selectively applying power to the electric heat coil.

3. The fan coil unit according to claim 2, wherein each of the plurality of electric heat coils varies in length.

4. The fan coil unit according to claim 2, wherein multiple switching devices are coupled to the plurality of electric heat coils.

5. The fan coil unit according to claim 2, wherein the mount plate is substantially flat and formed from a piece of sheet metal.

6. The fan coil unit according to claim 1, wherein multiple electric heat coil assemblies are positioned in an open space adjacent the heat exchanger assembly.

7. The fan coil unit according to claim 6, wherein the multiple electric heat coil assemblies are similar in size and/or shape.

8. The fan coil unit according to claim 6, wherein the multiple electric heat coil assemblies are different shapes and/or sizes.

9. The fan coil unit according to claim 1, wherein an electric heat coil assembly is positioned in more than one open space adjacent the heat exchanger assembly.

10. The fan coil unit according to claim 9, wherein a first open space exists between a first portion of the heat exchanger assembly and the housing duct, a second open space exists between a second portion of the heat exchanger assembly and the housing duct, and a third open space exists between the first portion and the second portion of the heat exchanger assembly.

11. The fan coil unit according to claim 10, wherein a first electric heat coil assembly is positioned within the first open space and a second electric heat coil assembly is positioned with the second open space.

12. The fan coil unit according to claim 11, wherein the first electric heat coil assembly and the second electric heat coil assembly are substantially similar.

13. The fan coil unit according to claim 11, wherein the first electric heat coil assembly and the second electric heat coil assembly are substantially different.

14. The fan coil unit according to claim 1, wherein the fan assembly is positioned adjacent an inlet duct of the housing.

15. The fan coil unit according to claim 1, wherein the fan assembly is positioned adjacent an outlet duct of the housing.

* * * * *